US006511113B1

(12) United States Patent
Kulage

(10) Patent No.: US 6,511,113 B1
(45) Date of Patent: Jan. 28, 2003

(54) SELF-ADJUSTING CONNECTOR AND RELATED METHODS OF CONNECTING

(76) Inventor: Timothy J. Kulage, 8783 W. Fairway, Baton Rouge, LA (US) 70809

( * ) Notice: Subject to any disclaimer, the term of this patent is extended or adjusted under 35 U.S.C. 154(b) by 0 days.

(21) Appl. No.: 09/658,354

(22) Filed: Sep. 11, 2000

Related U.S. Application Data

(60) Provisional application No. 60/153,109, filed on Sep. 9, 1999.

(51) Int. Cl.[7] ..... B66C 1/54

(52) U.S. Cl. ..... 294/97; 294/95

(58) Field of Search ..... 294/93, 86.24, 294/86.25, 86.31, 95, 97, 99.1

(56) References Cited

U.S. PATENT DOCUMENTS

| | | | | | |
|---|---|---|---|---|---|
| 141,233 | A | * | 7/1873 | Okerlund | 294/97 |
| 386,928 | A | | 7/1888 | Moser | 294/97 |
| 1,100,019 | A | * | 6/1914 | Johnson | 294/97 |
| 1,268,686 | A | * | 6/1918 | Craig | 294/86.24 |
| 1,282,479 | A | * | 10/1918 | Smith | 294/97 |
| 1,353,177 | A | * | 9/1920 | Nelson | 294/97 |
| 1,474,886 | A | * | 11/1923 | Boyce | 294/86.25 |
| 1,572,983 | A | * | 2/1926 | Barrier | 294/86.24 |
| 1,786,111 | A | * | 12/1930 | Garris | 294/86.24 |
| 1,804,843 | A | * | 5/1931 | Santiago | 294/93 |
| 2,526,725 | A | | 10/1950 | Bronson | 294/67.1 |
| 2,610,888 | A | * | 9/1952 | Pace | 294/93 |
| 2,759,757 | A | * | 8/1956 | Pace | 294/93 |
| 2,761,726 | A | * | 9/1956 | Ingram | 294/97 |
| 2,809,070 | A | * | 10/1957 | Nelson | 294/97 |
| 3,442,546 | A | * | 5/1969 | Bachman | 294/95 |
| 4,032,185 | A | * | 6/1977 | Peyton | 294/86.25 |
| 4,068,879 | A | | 1/1978 | Torbet et al. | 294/89 |
| 4,133,569 | A | | 1/1979 | Pavack et al. | 294/106 |
| 4,199,183 | A | * | 4/1980 | Hecker | 294/97 |
| 4,577,899 | A | * | 3/1986 | Hemingway | 294/97 |
| 4,715,631 | A | * | 12/1987 | Nakakima | 294/65.5 |
| 4,784,398 | A | | 11/1988 | Lund | 294/97 |

FOREIGN PATENT DOCUMENTS

| | | | | |
|---|---|---|---|---|
| DE | 40053 | | 7/1965 | 294/95 |
| GB | 1016876 | * | 9/1963 | 294/97 |

* cited by examiner

*Primary Examiner*—Christopher P. Ellis
*Assistant Examiner*—Paul T. Chin
(74) *Attorney, Agent, or Firm*—Sieberth & Patty, L.L.C.

(57) ABSTRACT

A device for connecting a first object to a second object the second object defining at least one surface which in turn defines a space, the device comprising (a) a member which may be connected to the first object, (b) a plurality of cams pivotally attached to the member, at least one of the cams defining an arcuate surface, and (c) a biasing object for biasing at least one of the cams against the surface of the second object, the member, the plurality of cams and the biasing object being sized and configured so that, when the member is connected to the first object and disposed within the space, upon biasing at least one of the cams, at least one of the cams pivots relative to the member so that the arcuate surface is placed and maintained in contact with at least one surface, thereby resisting force which might otherwise separate the first and second objects. A device for connecting a first object to a second object, each of the objects defining respectively at least one surface which in turn defines a respective space is further described, as are related methods of connecting objects to one another.

19 Claims, 8 Drawing Sheets

SELF-ADJUSTING CONNECTOR AND RELATED METHODS OF CONNECTING

REFERENCE TO RELATED APPLICATION

This application claims the benefit of U.S. Provisional Patent Application No. 60/153,109, filed on Sep. 9, 1999.

TECHNICAL FIELD

This invention relates to devices for attaching one object to another.

BACKGROUND

While many mechanical devices are known which connect or attach objects to one another, there remain many circumstances in which known mechanisms are too expensive, too complicated to use, and/or fail to adequately secure the objects to each other. One, but by no means the only, exemplary circumstance is that wherein one object is to be detachably attached to another hollow object which has an inner surface, using a force applied to the inner surface of the hollow object as a primary connecting force. U.S. Pat. No. 4,784,398 to Lund discloses an expandable chuck for insertion into a cylindrical hollow core. The chuck includes a plurality of jaws connected by a linkage to a central lifting post and a lower portion of the chuck body, whereby the jaws may move into and out of gripping engagement with the inner surface of the core. However, the chuck does require a continual lifting force to be applied to provide gripping engagement between the jaws and the inner surface of the core, and the jaws are described as having sharp outer ends, which requires the inner surface of the core to be soft enough to receive the sharp ends for binding engagement. In addition, the chuck disclosed does not easily adapt to cores of varying diameters.

U.S. Pat. No. 4,068,879 to Torbet et al. describes a hoisting apparatus which engages a socket cavity in concrete slab to enable lifting of the slab. However, the inner surface of the socket cavity must be specially formed in frustoconical fashion to receive pivoting engagement arms on the hoisting apparatus.

Thus, a need continues to exist for simple devices which enable the detachable connection of at least one object to at least one other object.

THE INVENTION

The present invention is deemed to meet the foregoing need in a highly efficient and effective way by enabling objects of a wide variety of sizes and shapes to be firmly, and preferably detachably, connected to one another.

In one of its embodiments, this invention provides a device for connecting a first object to a second object is provided, wherein said second object defines at least one surface which in turn defines a space. As used throughout this disclosure, including the appended claims, the term "space" is considered to mean a two or three dimensional area bounded by two or more substantially opposed surfaces, or by two or more substantially opposed portions of a single surface. The device is comprised of:

(a) a member which may be connected to said first object, (b) a plurality of cams pivotally attached to said member, at least one of said cams defining an arcuate surface, and (c) biasing means for biasing said at least one of said cams against said surface of said second object, (a), (b) and (c) being sized and configured so that, when said member is connected to said first object and disposed within said space, upon biasing said at least one of said cams, said at least one of said cams pivots relative to said member so that said arcuate surface is placed and maintained in contact with said at least one surface, thereby resisting force which might otherwise separate said first and second objects.

In another embodiment of this invention, a device for connecting a first object to a second object, wherein each of said objects defines respectively at least one surface which in turn defines a respective space, is provided. The device is comprised of:

(a) a first member and a second member, said members being connectable to one another, each of said members having a plurality of cams pivotally attached thereto, at least one of said cams of each of said members defining an arcuate surface, and (b) biasing means for biasing said at least one of said cams of each of said members against said at least one surface respectively, said members, cams and biasing means being sized and configured so that, when said members are connected and each of said members is disposed in its respective space, upon biasing, each of said at least one of said cams of each of said members pivots relative to its respective member so that said arcuate surface thereof is placed and maintained in contact with said at least one surface of its respective object, thereby resisting force which might otherwise separate said first and second objects.

In yet another embodiment of this invention, a device is provided for connecting a first object to a second object, the second object defining one or more inner surfaces which in turn define a cavity, such as, e.g., a bore. The device is comprised of (a) a member which may be directly or indirectly connected to the first object, (b) a plurality of cams pivotally attached to the member, and (c) biasing means for biasing the cams against at least one inner surface of the second object. To connect the first and second objects, the member is connected to the first object and placed in sufficient proximity to at least one inner surface of the second object so that, upon biasing of the cams, the cams pivot relative to the member and are placed and maintained in contact with at least one inner surface of the second object so as to bind the member to the second object, thereby attaching the first object to the second object.

In still another embodiment of this invention, a device is provided for connecting at least a first object to a second object, each of the objects defining respectively one or more inner surfaces which in turn define respective cavities, such as, e.g., a bore in each object. The device comprises (1) a first member and a second member, the members being detachably attached to one another, each of the members including a plurality of cams pivotally attached thereto, and (2) biasing means for biasing the first member cams against at least one inner surface of the first object and for biasing the second member cams against at least one inner surface of the second object. To connect the first and second objects, each member is placed in sufficient proximity to at least one inner surface of its respective object so that, upon biasing of the cams, the cams pivot relative to the member and are placed and maintained in binding contact with at least one inner surface of the associated object, thereby attaching the first object to the second object through the attachment of the first member to the second member.

As may now be appreciated, methods of connecting at least two objects together are also provided in another aspect of this invention. Thus, in one embodiment of the invention a method is provided for connecting a first object to a second object, said second object defining at least one surface which in turn defines a space. The method comprises:

(a) placing within said space a member which is connected to said first object and has pivotally attached thereto a plurality of cams, at least one of said cams defining an arcuate surface, (b) biasing said at least one of said cams defining an arcuate surface so that said arcuate surface is placed and maintained in contact with said at least one surface, to thereby resist force which might otherwise separate said first and second objects.

Yet another embodiment of this invention is a method for connecting a first object to a second object, each of said objects defining respectively at least one surface which in turn defines a respective space. This method comprises:

(a) placing within each respective space a member which has pivotally attached thereto a plurality of cams, at least one of said cams in each of said plurality of cams defining an arcuate surface, and (b) biasing said at least one of said cams in each of said plurality of cams so that said arcuate surface is placed and maintained in contact with said at least one surface, respectively, to thereby resist force which might otherwise separate said first and second objects.

These and other embodiments and features of the invention will become still further apparent from the ensuing description and accompanying drawings.

BRIEF DESCRIPTION OF THE DRAWINGS

In each of the above figures, like numerals are used to refer to like or functionally like parts among the several figures.

DETAILED DESCRIPTION OF PREFERRED EMBODIMENTS

Figure 1:
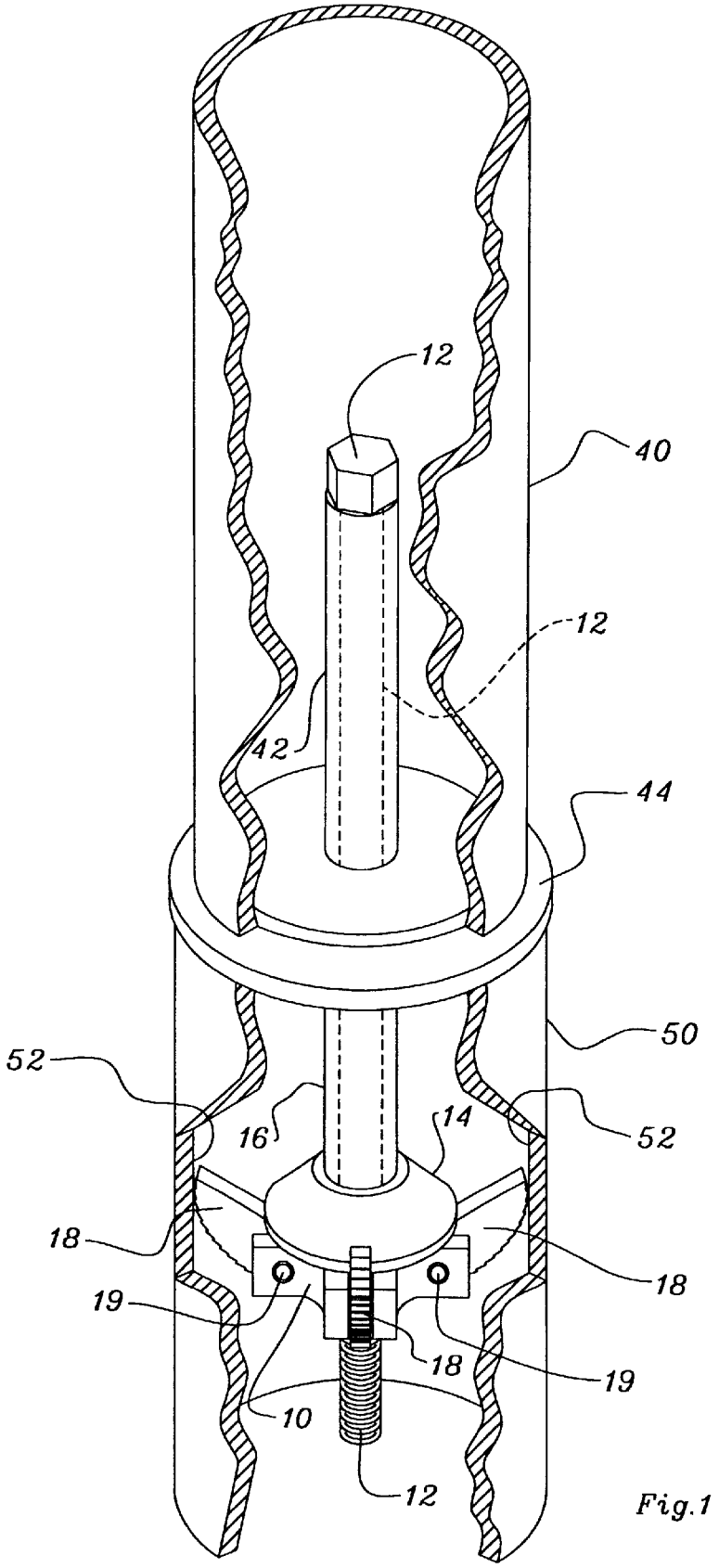
FIG. 1 is a view in perspective of a device of this invention, with surrounding pipe segments being partially broken away.

Referring now to the drawings, it will be appreciated that the particular objects being connected are comprised of a light fixture housing and a hollow cylindrical pole for the fixture. However, it will be appreciated from this disclosure that such a use is only one of many potential applications of devices of this invention. From the depicted preferred embodiments it will also be noted that preferably each member employed in devices of this invention is a draw knuckle or similar mechanical component. As seen from the preferred embodiment depicted in FIGS. 1–3, a first object, cylindrical housing 40, is being attached to a second object, hollow pipe 50. The device depicted is comprised of a member in the form of a draw knuckle 10 connected to cylindrical housing 40 via motive means in the form of a threaded draw bolt 12 which extends through a base plate cylinder 42 in housing 40 and is threadably received by knuckle 10 so as to enable adjustment in proximity of knuckle 10 to housing 40. The biasing means depicted is thus comprised of draw bolt 12 and an abutting surface defined by an abutting object, which object in the preferred embodiment depicted is a washer 14 suspended a distance from housing 40 via extension cylinder 16 and sized and configured to receive draw bolt 12. Four cams 18 are substantially annularly disposed about, and pivotally attached to, knuckle 10 via respective pivot pins 19. Washer 14 causes cams 18 to pivot so as to bias cams 18 against an inner surface 52 of hollow pipe 50, when draw knuckle 10 is brought into closer proximity to washer 14 and housing 40. When draw bolt 12 is received by washer 14 and threadably received by draw knuckle 10, knuckle 10 may be brought toward housing 40 when bolt 12 is appropriately rotated. That is, upon such rotation, washer 14 makes contact with each of cams 18 as knuckle 10 is drawn towards washer 14 and washer 14 forces cams 18 to pivot so as to extend radially outwardly from the center of draw knuckle 10 and into contact with inner surface 52 defined by pipe 50. As seen in FIG. 2, the device is detachably attached to housing 40 through bolt 12.

Figure 2:
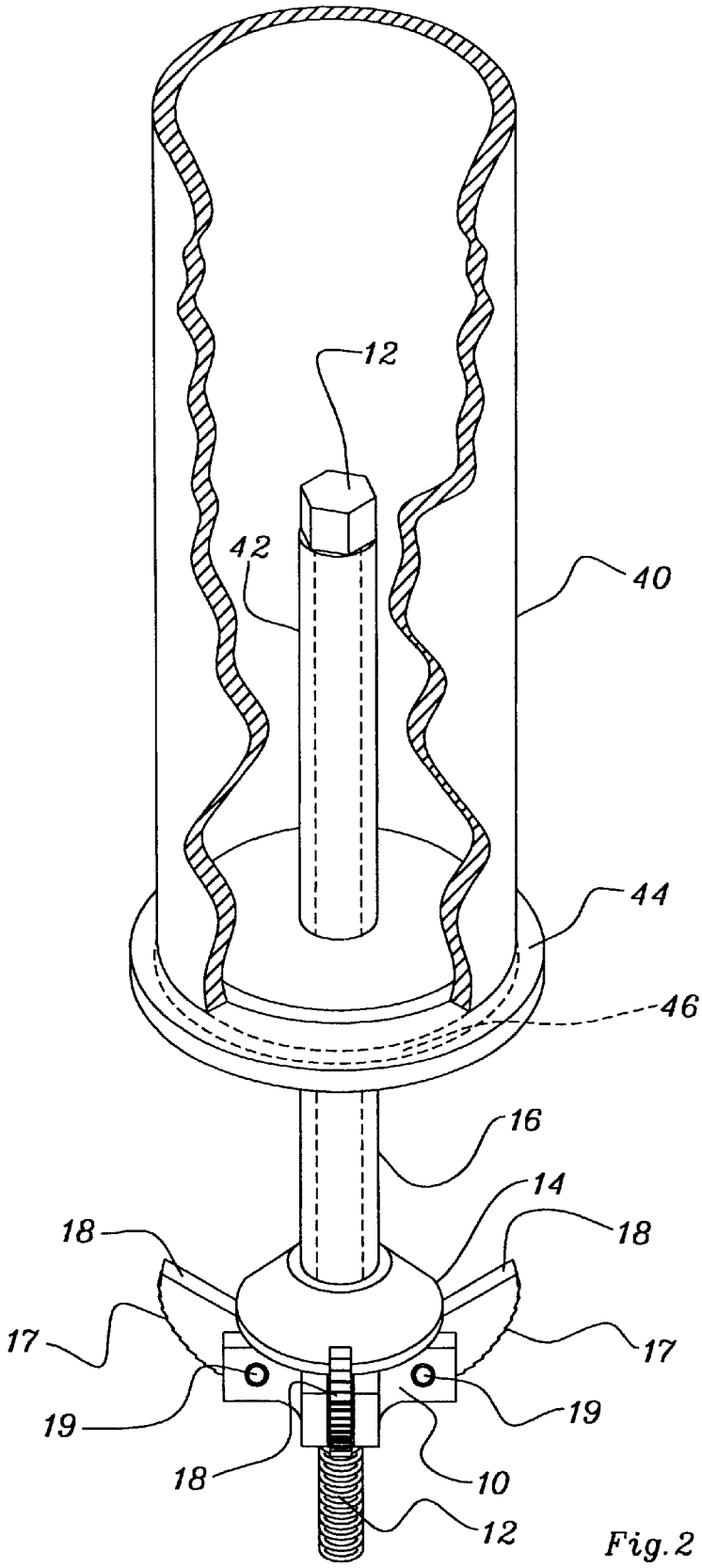
FIG. 2 is a view in perspective of a portion of the device of FIG. 1, with a surrounding pipe segment being partially broken away.

Also present in the preferred embodiment depicted in FIGS. 1–2 is a base plate 44 attached to housing 40, base plate 44 including a plateau 46 extending from plate 44 opposite housing 40, plateau 46 being sized and configured to mate with the bore formed by pipe 50. Plateau 46 provides additional lateral stability to the joint between housing 40 and pipe 50.

Figure 4:
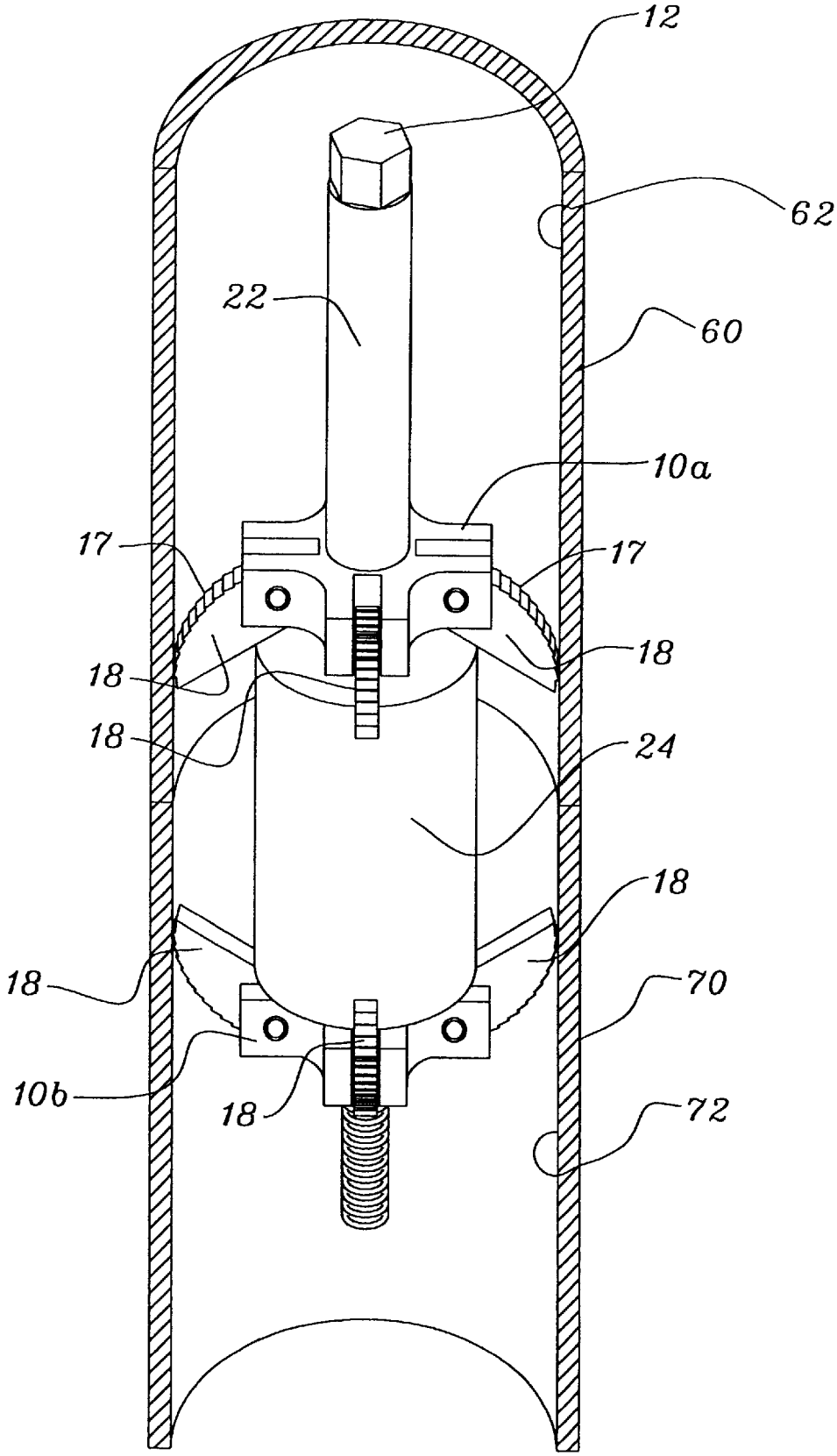
FIG. 4 is a view in perspective of another embodiment of this invention, with surrounding pipe segments shown in cross-section.

FIG. 4 depicts another preferred embodiment of this invention. Pipe segments 60 and 70 define respective inner surfaces 62 and 72 and are detachably attached to one another by way of the device of this invention. The device is comprised of two draw knuckles 10*a* and 10*b*, each including four pivotally attached cams 18, extension cylinder 22, biasing washer 24 and a threaded draw bolt 12 received by cylinder 22 and washer 24 and threadably received by at least knuckle 10*b*. When bolt 12 is appropriately rotated, knuckle 10*b* may be drawing toward knuckle 10*a*, whereupon the respective ends of biasing washer 24 contact cams 18 of each of knuckles 10*a* and 10*b* to force cams 18 to pivot and extend radially outwardly from the center of their respective draw knuckles 10*a* and 10*b*. Cams 18 are thus urged into and maintained in binding contact with inner surfaces 62 and 72, respectively.

Figure 5:
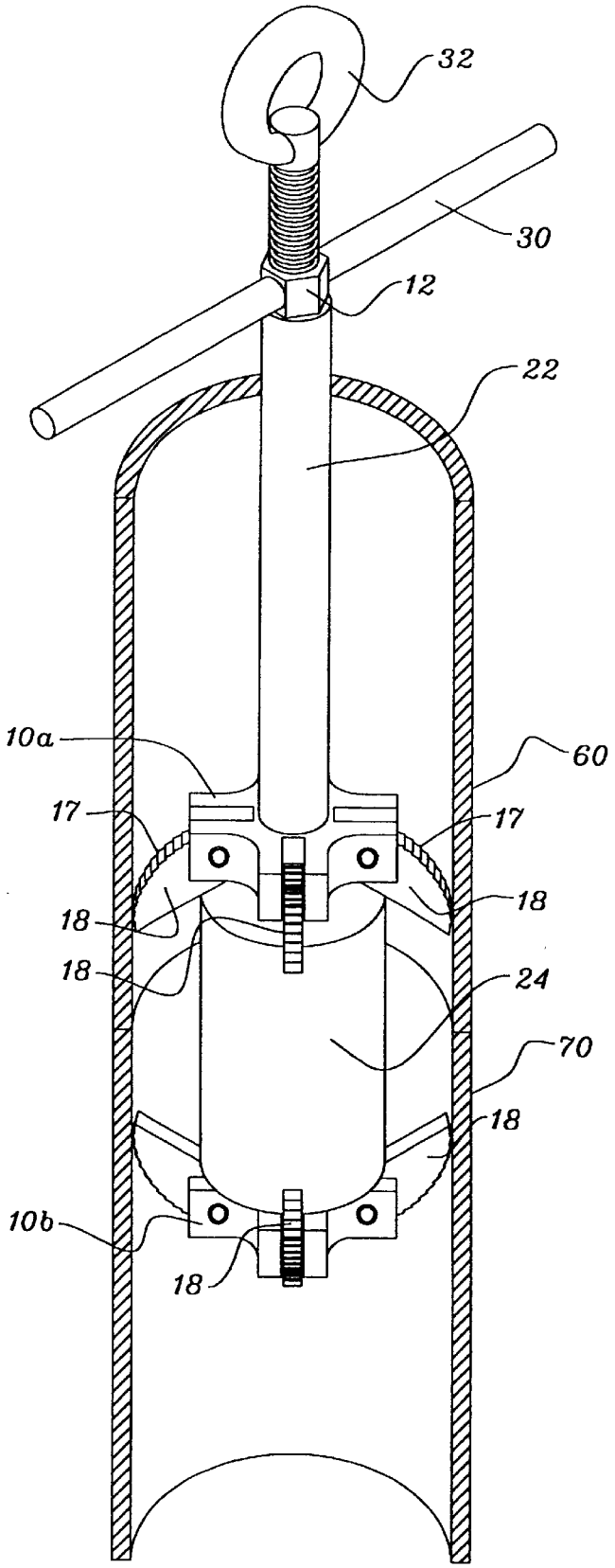
FIG. 5 is a view in perspective of a modified version of the device of FIG. 4, with surrounding pipe segments shown in cross-section.

FIG. 5 depicts yet another preferred embodiment of this invention, in which the device of FIG. 4 has been modified to add a handle extension 30 and a lifting ring 32 to the head of draw bolt 12. This illustrates one of a variety of modifications to the biasing means and other components of this invention which may be made to the devices without deviating from the spirit of the invention.

Figure 6:
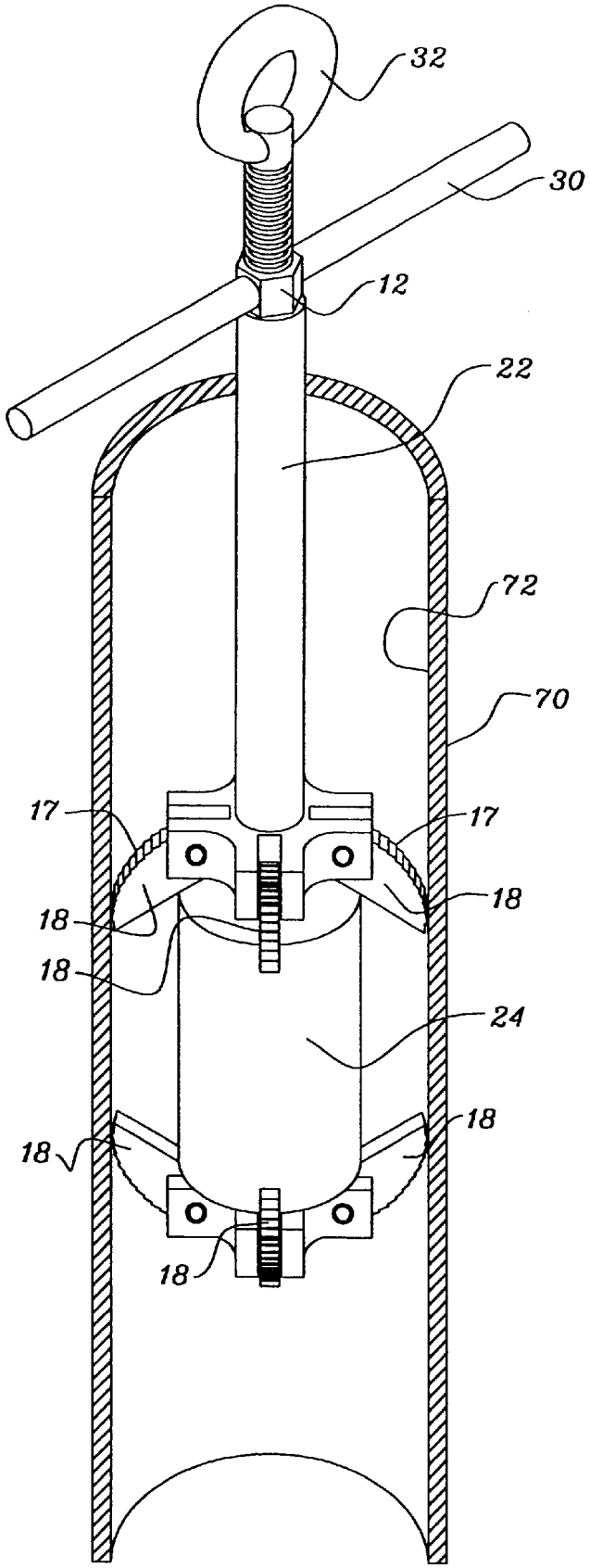
FIG. 6 is another view in perspective of the device of FIG. 5, with the surrounding pipe segment shown in cross-section.

As can be seen in FIG. 6, this invention also provides a lifting device for connecting an object to a lifting device such as, e.g., a crane line. The dual knuckle cam device of FIG. 5 is employed in the application illustrated in FIG. 6, but the device is inserted into a single pipe segment 70 so that upon actuation of the biasing means, binding contact is made between cams 18 and inner surface 72. Lifting ring 32 may then be connected to the end of a crane line (not shown) or other device to enable a user to lift, pull or otherwise apply force to pipe segment 70 through the connection provided by the dual knuckle cam device shown.

Figure 7:
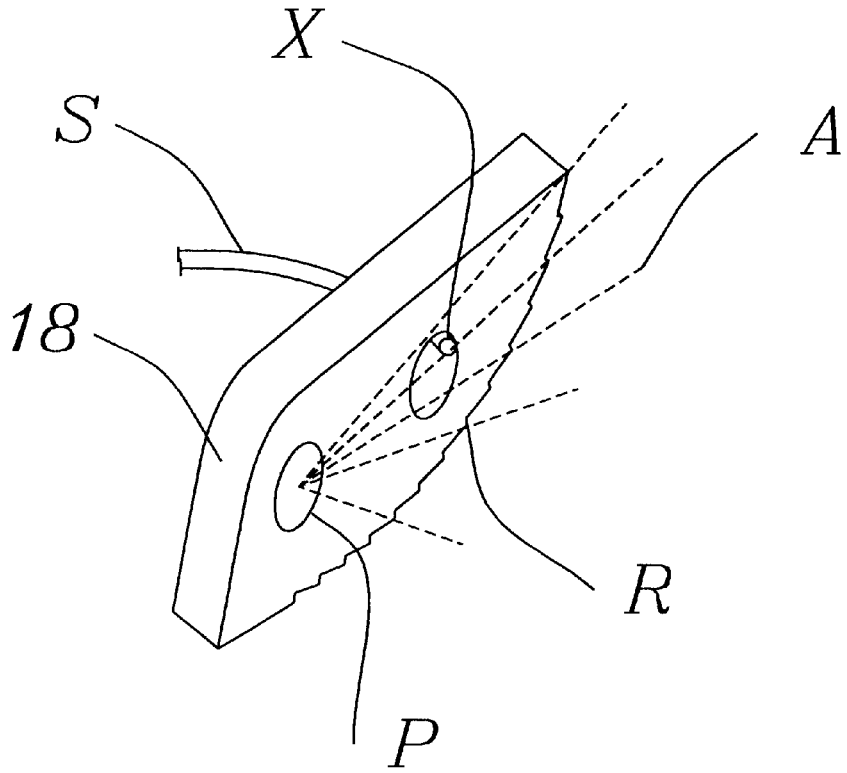
FIG. 7 is an elevated view in perspective of a cam from the device of FIG. 1.

As may be seen in all of the figures, and especially with reference to FIG. 7, it is particularly preferred that cams 18 each define an arcuate surface 17 which is ridged and configured to form binding contact between itself and a proximate surface when biased against and maintained in contact with that surface. With reference to FIG. 7, it will be appreciated that each ridge R is formed in a plane which is tangential to a center line A extending from the pivot point P of associated cam 18. It is believed that this particularly preferred ridge configuration facilitates the creation of binding contact between the cam and its surrounding surface. The arcuate configuration also enables the devices of this invention to be self-adjusting in that they may be used and reused to attach objects of various dimensions. The objects are firmly yet detachably attached to one another, while the pivotal relationship of the cams to their associated knuckle enables the cams to release from binding contact with the proximate surface when the biasing force is removed by rotating the draw bolt in the opposite direction from that used to apply the biasing force. Upon rotation in the direction for releasing the biasing force, the draw knuckle is drawn away from the washer so that the washer is no longer in rigid contact with the cams and the cams are no longer biased into and maintained in contact with the proximate surface.

It will also be appreciated from FIG. 7 that in particularly preferred embodiments of this invention each cam further defines an aperture X through which is threaded a coil spring segment S. Segment S constitutes counter-biasing means in the device for providing a counter-biasing force to the biasing force so that, when the counter-biasing force exceeds the biasing force, cams 18 are drawn radially inwardly to facilitate device removal from the space in which it has been disposed to establish a connection.

Figure 3:
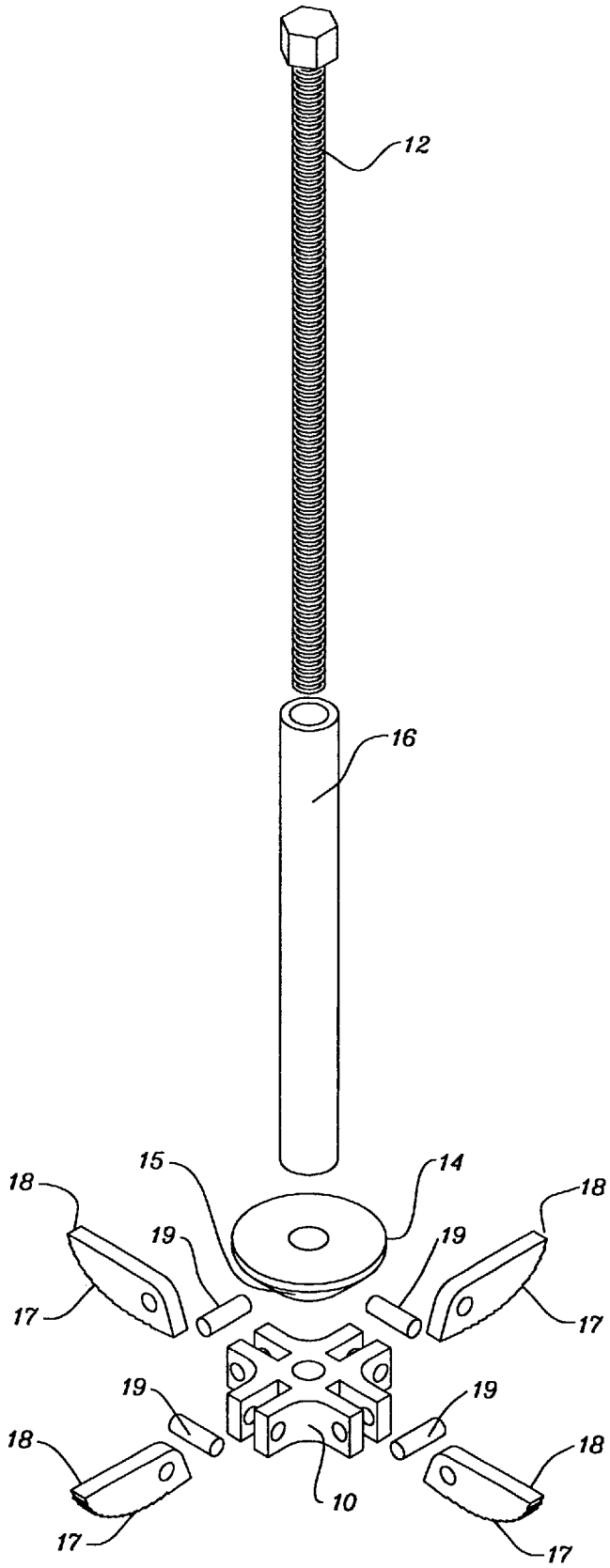
FIG. 3 is an exploded view in perspective of a portion of the device of FIG. 1.
Figure 8A:
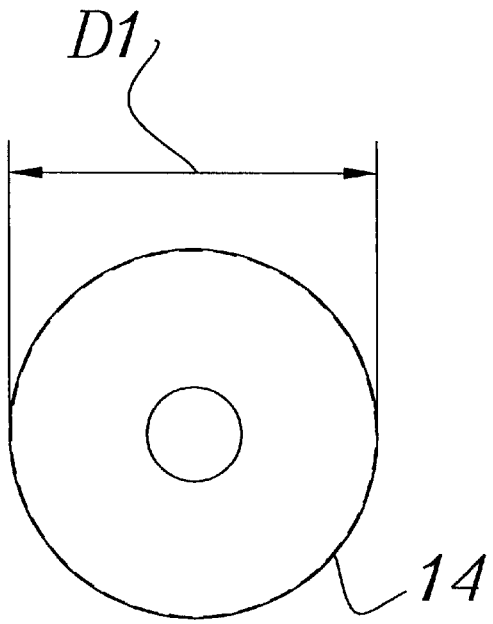
FIG. 8A is a top plan view of a washer from the device of FIG. 1.
Figure 8B:
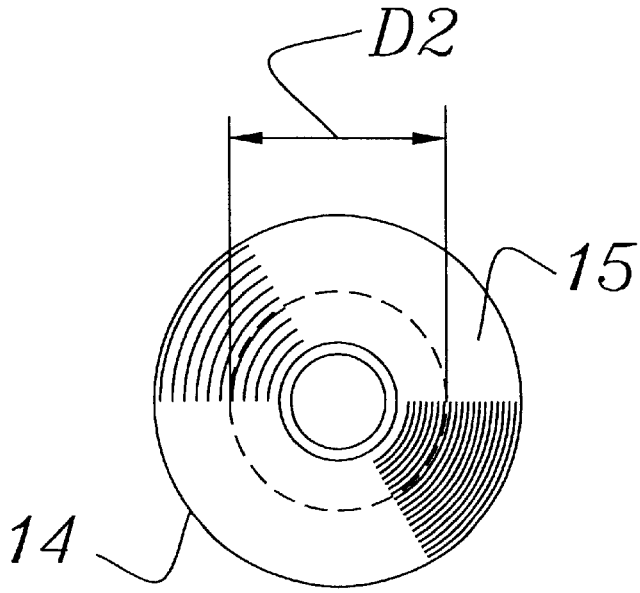
FIG. 8B is a bottom plan view of the washer of FIG. 8A.

When present, the washer employed in certain preferred embodiments of this invention defines an outer annular surface which may be tapered, as may be seen in FIGS. 1, 2, 3, 8A and 8B. When positioned as seen in FIG. 3, this tapered surface 15 is sloped relative to the plane occupied by the opposite surface of the washer and enables even more effective biasing of cams 18 against inner surfaces which may be separated by smaller distances, or in cases where there is only one inner surface, as in FIGS. 1, 4 and 5, when surface 52 defines a bore of relatively small diameter. When maximum extension of cams 18 is desired, washer 14 may be turned over during installation of the device, as seen in FIGS. 1 and 2, so that along its entire diameter washer 14 may contact cams 18 during biasing of cams 18 against inner surface 52. Thus, from FIGS. 8A and 8B it will be appreciated that washer 14 provides two alternative abutting surfaces, each having a cam contact diameter. Abutting surface 15 provides at least one alternative cam contact diameter D2 (FIG. 8B) which is smaller than the cam contact diameter D1 of the first abutting surface of washer 14 (FIG. 8A). This particularly preferred configuration enables the devices of invention to function in a wide variety of spaces, e.g., various bore diameters in cylindrical pipes.

It will also be appreciated that the cams of devices of this invention may be sized to be particularly suited to a given circumstance, and the cams are preferably replaceable so as to enable the basic assembly to be conveniently customized for the dimensions of a given application. If the diameter of the bore or other cavity formed by the inner surface(s) of an object will vary from object to object, cams of appropriate size may be selected and installed on the draw knuckle or other member, thereby increasing the range of cavity dimensions in which the device may be employed. Also, the number of cams pivotally attached to each member employed in preferred embodiments of this invention may vary depending upon the requirements of a given application, but preferably will be sufficient to provide a secure connection between the objects with minimal rotation therebetween.

Generally speaking, the biasing means of this invention may be comprised of a wide variety of mechanical, pneumatic, hydraulic and/or electric devices, including but not limited to hydraulic rams, pneumatic rams, electromagnetic rams, draw bolts, and the like. Preferably, the biasing means is comprised of motive means for providing motion to the member, and an abutting surface defined by an abutting object fixed in position relative to the first object. The motive means of this invention may be comprised of, e.g., an inclined plane, cable and levered pulley devices, draw chains or other mechanical devices, hydraulic or pneumatic cylinders or rams, electromagnetic devices, or the like, including combinations of any two or more of the foregoing. As noted above, in the particularly preferred embodiment depicted, the motive means is comprised of an inclined plane device (threaded draw bolt) which cooperates with an abutting surface formed by a washer. In circumstances wherein the relationship between the bolt and the member is such that, upon rotation of the bolt the member rotates freely within the space and the cams fail to produce frictional force at the point of ridge contact, it may also be desirable to provide a mechanical stabilizer to stabilize the member (e.g., the draw knuckle) relative to the first object to cause the incline plane of the bolt to force the member to move as desired. One non-limiting example of a suitable mechanical stabilizer is comprised of one or more rods or tubes fixedly attached to the first object and extending therefrom into proximity with the member so that rotation of the member relative to the first object is inhibited.

Counter-biasing means of this invention may be comprised of, e.g., gravity, a coil, leaf or hinge spring or spring segment, elastomeric bushings, or the like, including combinations of any two or more of the foregoing, but is preferably a coil spring segment for the particularly preferred embodiment of FIG. 7 described above.

The dimensions of the various component parts of devices of this invention may vary depending upon the settings in which the device will be employed, so long as the dimensions permit the components to function as described herein. The component parts may be fabricated from a wide variety of materials, the selection of which will depend again upon the settings in which the device will be employed. Preferably, metals, metal alloys or resilient plastics, for example, will be employed to insure that points of mechanical contact in the device will be resilient enough to withstand the forces placed upon them by the device and the objects being connected.

Each and every patent or printed publication referred to above is incorporated herein by reference in toto to the fullest extent permitted as a matter of law.

This invention is susceptible to considerable variation in its practice. Therefore, the foregoing description is not intended to limit, and should not be construed as limiting, the invention to the particular exemplifications presented hereinabove. Rather, what is intended to be covered is as set forth in the ensuing claims and the equivalents thereof permitted as a matter of law. As used in this description and the appended claims, means-plus-function clauses are intended to cover the structures described herein as performing the cited function and not only structural equivalents but also equivalent structures.

That which is claimed is:

1. A device for connecting a first object to a second object, said second object defining at least one surface which in turn defines a space, said device being comprised of:

(a) a member which may be connected to said first object, (b) a plurality of cams pivotally attached to said member, at least one of said cams defining an arcuate surface, (c) biasing means for biasing said at least one of said cams against said surface of said second object, and (d) counter-biasing means for applying an opposing force to that applied by said biasing means, said member, said plurality of said cams and said biasing means being sized and configured so that, when said member is connected to said first object and disposed within said space, upon biasing said at least one of said cams, said at least one of said cams pivots relative to said member so that said arcuate surface is placed and maintained in contact wit said at least one surface, thereby resisting force which might otherwise separate said first and second objects.

2. A device according to claim 1 wherein said arcuate surface is stepped so as to define a plurality of ridges.

3. A device according to claim 2 wherein at least one of said plurality of ridges is formed in a plane which is tangential to an imaginary center line extending from the pivot point of said at least one of said cams.

4. A device according to claim 1 wherein said member is comprised of a draw knuckle.

5. A device according to claim 1 wherein said biasing means is comprised of motive means for moving said member, and a first abutting surface defined by an abutting object fixed in position relative to said first object, whereby said member may be brought toward said abutting object so that said at least one of said cams contacts said first abutting surface and pivots relative to said member so as to be biased against said at least one surface.

6. A device according to claim 5 wherein said motive means is comprised of a threaded draw bolt which is threadably received by said member.

7. A device according to claim 5 wherein said cams are annularly disposed about the periphery of said member, wherein each of said cams defines a respective arcuate surface, and wherein said biasing means is further comprises of a second abutting surface defined by said abutting object, said second abutting surface being sloped relative to a plane occupied by said first abutting surface, each of said first and second abutting surfaces having a cam contact diameter, said second abutting surface providing at least one alternative cam contact diameter which is less than the cam contact diameter of said first abutting surface.

8. A device according to claim 1 wherein said second object comprises a hollow, cylindrical object and said at least one surface is an inner surface defined by said hollow, cylindrical object.

9. A device according to claim 8 wherein said arcuate surface is stepped so as to define a plurality of ridges.

10. A device according to claim 9 wherein at least one of said plurality of ridges is formed in a plane which is tangential to an imaginary center line extending from the pivot point of said at least one of said cams.

11. A device according to claim 8 wherein said member is comprised of a draw knuckle.

12. A device according to claim 8 wherein said biasing means is comprised of motive means for moving said member, and an abutting surface defined by an abutting object fixed in position relative to said first object, whereby said member may be brought toward said abutting object so that said at least one of said cams contacts said abutting surface and pivots relative to said member as to be biased against said at least one surface.

13. A device according to claim 12 wherein said motive means is comprised of a threaded draw bolt which is threadably received by said member.

14. A device according to claim 1 wherein said counter-biasing means comprises at least one spring which counter-biases at least one of said cams.

15. A device for connecting a first object to a second object, said second object defining at least one surface which in turn defines a space, said device being comprised of:

(a) a member which may be connected to said first object, (b) a plurality of cams pivotally attached to said member, annularly disposed about the periphery of said member, wherein each of said cams defines an arcuate surface, and (c) biasing means for biasing said at least one of said cams against said surface of said second object, wherein said biasing means is comprised of motive means for moving said member, a first abutting surface defined by an abutting object fixed in position relative to said first object, whereby said member may be brought toward said abutting object so that said at least one of said cams contacts said first abutting surface and pivots relative to said member so as to be biased against said at least one surface, and a second abutting she defined by said abutting object, said second abutting surface being sloped relative to a plane occupied by said first abutting surface, each of said first and second abutting surfaces having a cam contact diameter, said second abutting surface providing at least one alternative cam contact diameter which is less than the cam contact diameter of said first abutting surface, said member, said plurality of cams and said biasing means being sized and configured so that, when said member is connected to said first object and disposed within said space, upon biasing said at least one of said cams, said at least one of said cams pivots relative to said member so that said arcuate surface is placed and maintained in contact with said at least one surface, thereby resisting force which might otherwise separate said first and second objects.

16. A device according to claim 15 wherein said arcuate surface is stepped so as to define a plurality of ridges and wherein at least one of said plurality of ridges is formed in a plane which is tangential to an imaginary center line extending from the pivot point of said at least one of said cams.

17. A device according to claim 15 wherein said member is comprised of a draw knuckle.

18. A device according to claim 15 wherein said motive means is comprised of a threaded draw bolt which is threadably received by said member.

19. A device according to claim 15 wherein said second object comprises a hollow, cylindrical object and said at least one surface is an inner surface defined by said hollow, cylindrical object.

* * * * *